US005730687A

United States Patent [19]

Ledany

[11] Patent Number: 5,730,687

[45] Date of Patent: Mar. 24, 1998

[54] VIBRATORY EXERCISE DEVICE

[76] Inventor: Ori Ledany, 1550 Sandpebble Dr., Apt. 31, Wheeling, Ill. 60090

[21] Appl. No.: 567,753

[22] Filed: Dec. 5, 1995

[51] Int. Cl.[6] ..... A63B 21/02; A61H 1/00

[52] U.S. Cl. ..... 482/121; 482/122; 482/126; 601/23

[58] Field of Search ..... 482/91, 92, 95, 482/121, 122, 126, 131, 907, 908; 601/23, 31, 46, 49, 50, 53, 56–59, 84–86, 124, 125, 128, 129, 132

[56] References Cited

U.S. PATENT DOCUMENTS

| | | | |
|---|---|---|---|
| 681,331 | 8/1901 | Milkman | 601/132 |
| 3,204,955 | 9/1965 | Quire | 482/91 |
| 4,136,685 | 1/1979 | Ramey | 601/57 |
| 5,108,096 | 4/1992 | Ponce | 482/125 |
| 5,183,034 | 2/1993 | Yamasaki et al. | 601/56 |
| 5,305,738 | 4/1994 | Shimizu | 601/56 |
| 5,374,238 | 12/1994 | Xiao | 601/56 |
| 5,588,953 | 12/1996 | Chang | 601/132 |

*Primary Examiner*—Richard J. Apley
*Assistant Examiner*—Denise Pothier
*Attorney, Agent, or Firm*—Michael A. Bondi

[57] ABSTRACT

An isometric exercise device including a stretchable member and a vibratory portion. The isometric exercise device enables a person to perform an isometric exercise using the stretchable member while the vibratory portion generates vibratory pulses that are useful in providing a massaging action to a portion of the person's body.

20 Claims, 2 Drawing Sheets

VIBRATORY EXERCISE DEVICE

BACKGROUND OF THE INVENTION

The present invention relates generally to an isometric exercise device. More particularly, the present invention relates to a massaging isometric exercise device.

As society continues to become more and more technologically advanced, people are physically exerting themselves to increasingly lesser degrees in conjunction with work and recreational activities. Concomitantly many people are consuming greater amounts of foods that contain high levels of fats and cholesterol. As a result of these factors, the average weight of many people is greater than what would be considered the ideal weight for their body structure.

In an effort to overcome the potential negative physiological effects of weighing more than the ideal body weight, a portion of society engages in recreational exercise activities. Walking, bicycling, and roller skating are common forms of recreational exercise activities. However, the ability to walk, bicycle, and roller skate is limited by environmental conditions, such as sun light, rain, and snow. Additionally, walking, bicycling, and roller skating only exercise a small proportion of the muscle groups in a human body.

Many forms of in-door recreational exercise activities are also popular. There are primarily two locations for performing in-door recreational exercise activities: at a commercial exercise facility or at home.

An advantage of performing in-door recreational exercise activities at a commercial exercise facility is that the costs of purchasing and maintaining exercise equipment is amortized over a large number of people. As such, the commercial exercise facility is able to provide a variety of exercise equipment that enables people who use the commercial exercise facility to perform a wide range of exercises and thereby condition many muscle groups in the human body.

A drawback of conducting recreational exercise activity at a commercial exercise facility is that a person must pay periodic membership fees to obtain the right to use the commercial exercise facility. Additionally, the ability to conduct the recreational exercise activities is limited by the hours at which the commercial exercise facility is open for business as well as the proximity of the commercial exercise facility to the user's home or business.

To enjoy a greater degree of flexibility in conducting in-door recreational exercise activities, it is also common to use a portion of a person's home for conducting the recreational exercise activities. An advantage of performing recreational exercise activities in one's home is that the person may perform the exercise activities at any time that the exercise activities fit into the person's schedule. The person purchases the types of exercise equipment that are suited for the particular types of exercise activities.

The ability to have a wide range of exercise equipment is typically limited by the cost of purchasing the exercise equipment because the cost is not amortized over a large number of users. The ability to have a wide range of exercise equipment is also limited by the portion of the person's home that is allotted for using and storing the exercise equipment.

When purchasing exercise equipment for use in a home, it is desirable for the exercise equipment to be usable for exercising a wide range of muscle groups. It is also desirable for the exercise equipment to be suitable for compact storage when the exercise equipment is not being used.

One such exerciser is disclosed in Ponce U.S. Pat. No. 5,108,096. The Ponce exerciser uses latex surgical rubber tubing in conjunction with handles and knotting plates. The knotting plates allow the separation of the handles on the latex surgical rubber tubing to be varied depending on the exercise that is being performed.

SUMMARY OF THE INVENTION

The present invention includes an isometric exercise device having a stretchable member and a vibratory portion. The stretchable member is connected in an endless loop. The vibratory portion is retained in a captivated relationship with respect to the stretchable member. The isometric exercise device allows a person to perform an isometric exercise using the stretchable member while receiving a massage from the vibratory portion.

DETAILED DESCRIPTION OF THE PREFERRED EMBODIMENTS

Figure 1:
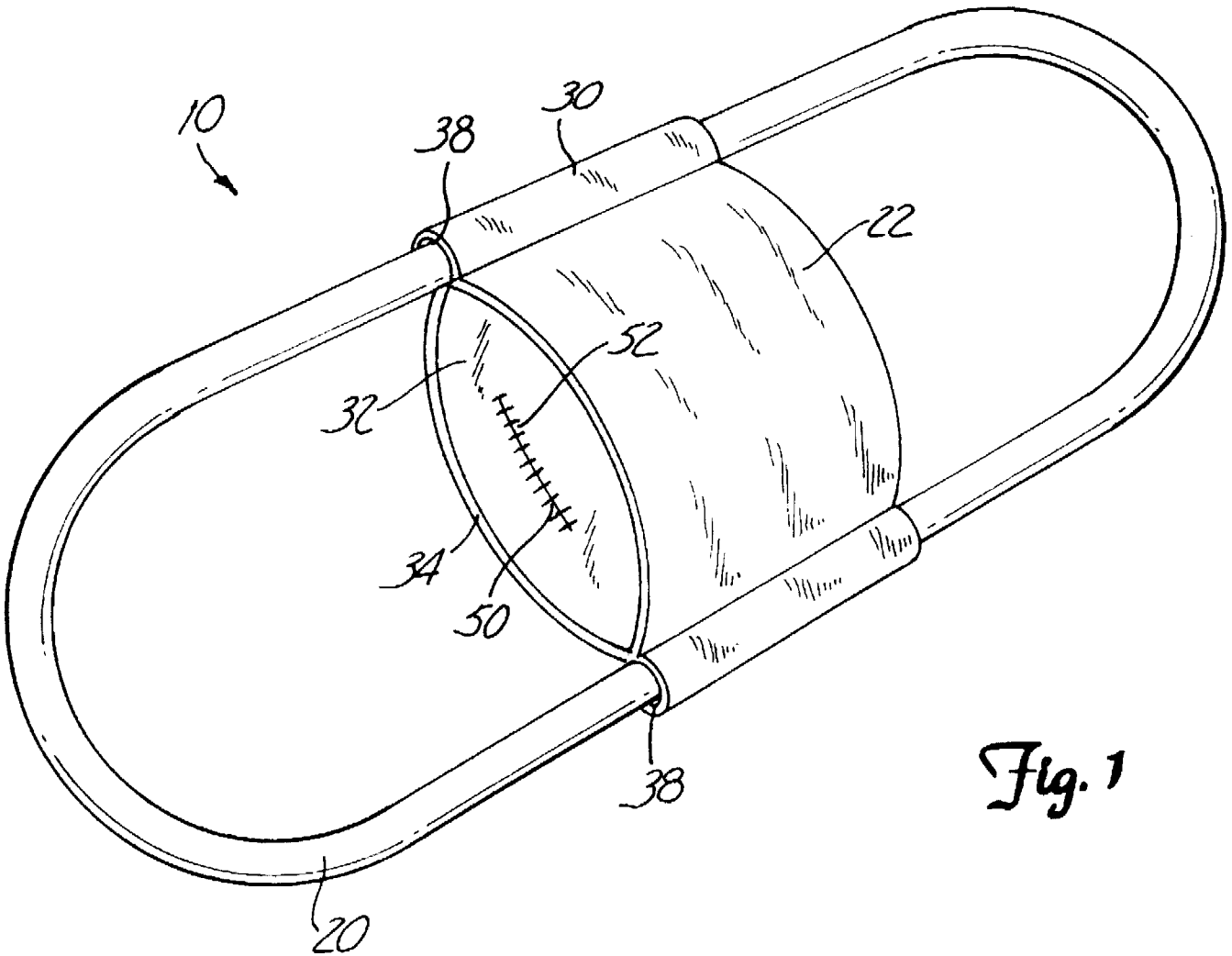
FIG. 1 is a perspective view of an isometric exercise device according to the present invention.

The present invention includes an isometric exercise device, as illustrated at 10 in FIG. 1. The isometric exercise device 10 includes a stretchable member 20 and a vibratory portion 22. The stretchable member 20 and the vibratory portion 22 are preferably retained in a captivated relationship with respect to each other.

The stretchable member 20 is preferably made of latex surgical rubber tubing. However, any similarly resilient material may be utilized for the stretchable member 20. The stretchable member 20 may be selected with any convenient diameter depending on the desired level of resistance. For example, the stretchable member is typically selected with a diameter of ¼ of an inch for less strenuous exercises and ¾ of an inch for more strenuous exercises. Alternatively, a thickness of the wall of the stretchable member 20 may be varied to obtain a desired level of resistance.

Ends of the stretchable member 20 are permanently bonded to each other so that the stretchable member 20 forms a continuous loop. The bonding of the ends 24 is sufficiently strong so that the ends 24 remain bonded as the stretchable member 20 is repeatedly stretched during exercise.

Alternatively, the ends 24 of the stretchable member 20 are removably attached to each other using a clamping mechanism (not shown). Removably attaching the ends 24 allows the ends 24 to be separated from each other.

The vibratory portion 22 includes a sleeve 30 and a vibratory mechanism 32. The sleeve 30 includes a large passage 34 that is adapted to receive the vibratory mechanism 32. The large passage 34 is selected with a size that approximately conforms with a diameter 36 of the vibratory mechanism 32. Selecting the large passage 34 with a size that conforms with the diameter 36 of the vibratory mechanism 32 allows the vibratory mechanism 32 to be retained in the large passage 34 while permitting the vibratory mechanism 32 to be removed from the large passage 34.

The sleeve 30 also includes a pair of small passages 38 that are adapted to receive the stretchable member 20. The small passages 38 are preferably oriented directly opposite each other adjacent to the large passage 34. The small passages 38 are selected with a size that approximately conforms with the diameter of the stretchable member 20. Selecting the small passages 38 with a size the conforms with the diameter of the stretchable member allows the stretchable member 20 to be retained in the small passages 38.

The sleeve 30 is preferably fabricated from a cylindrical material that has been separated into the large passage 34 and the small passages 38 by stitching or otherwise fastening the cylindrical material along two lines that are parallel to a central axis of the vibratory portion 22. The sleeve is preferably formed from either cloth, vinyl, or leather.

Figure 2:
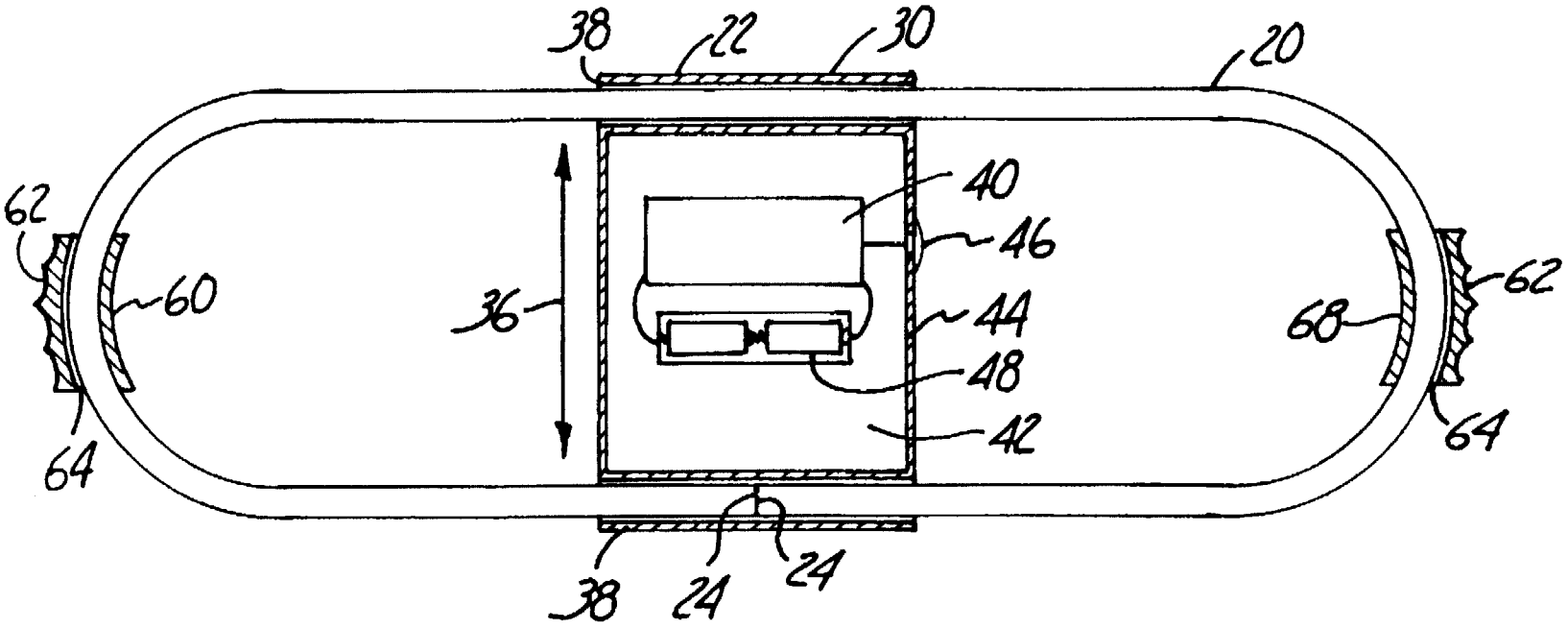
FIG. 2 is a sectional view of the isometric exercise device.

The vibratory mechanism 32 includes a vibratory motor 40 that is capable of transmitting vibratory pulses, as most clearly illustrated in FIG. 2. To protect the vibratory motor 40 from contacting a person's body and to transmit the vibratory pulses over a larger surface area, the vibratory motor 40 is preferably covered by an expanded foam portion 42. The expanded foam portion 42 is preferably formed in a substantially cylindrical shape. The thickness and firmness of the expanded foam portion 42 are selected to protect a person from direct contact with the vibratory motor 40 while transmitting the vibratory pulses to a desired extent.

The expanded foam portion 42 is covered by a protective layer 44 to protect the expanded foam portion 42 from damage while the isometric exercise device 10 is being used. The protective layer 44 is preferably formed from either cloth, vinyl or leather.

Operation of the vibratory motor 40 is preferably controlled by a switch 46 mounted on a end of the vibratory mechanism 32. In addition to turning the vibratory motor 40 on and off, the switch 46 may also have the ability to adjust the speed and intensity of the vibrations that are emitted by the vibratory motor 40.

Preferably, operation of the vibratory motor 40 is preferably powered by a plurality of batteries 48 that are removably mounted in the vibratory mechanism 32. The batteries 48 are oriented in the expanded foam portion 42 to protect a person's body from contacting the batteries 48 when the isometric exercise device 10 is used.

Additionally, the protective layer 44 contains access port 50 that enables a person to access the batteries 48 and the vibratory motor 40. The access port 50 thereby enables a person to change the batteries when the batteries are no longer able to power the vibratory motor 40. The access port 50 also enables a person to remove the vibratory motor 40 from the vibratory mechanism 32 to perform maintenance on the vibratory motor 40.

The access port 50 is preferably retained in a closed relation with a zipper 52. The access port 50 may also be retained in a closed relation using a a hook and loop fastener.

The isometric exercise device 10 also preferably includes a pair of handles 60. The handles 60 preferably each include a plurality of indentions 62 that are oriented to conform with the hand of person using the isometric exercise device 10. Each of the handles 60 also preferably has an elongated bore 64 that is adapted to receive the stretchable member 20.

The handles 60 are retained in an assembled relation with respect to the stretchable member by passing the end of the stretchable member 20 through the elongate bores 64 on each of the handles 60 and the permanently bonding the ends together. Alternatively, removably attaching the ends of the stretchable member allows the handles 60 to be removed from the stretchable member when it is desired to perform exercises that are not suited to using the handles 60.

The isometric exercise device 10 of the present invention thereby allows a person to perform an isometric exercise using the stretchable member 20 while obtaining a massage from the vibratory portion 22. For example, the vibratory portion 22 may be placed behind the person's neck while holding the handles 60 in the person's hands. The person then bends her arms to exercise the bicep and tricep muscles by stretching and relaxing the stretchable member 20. At the same time, the person is experiencing the vibratory pulses from the vibratory portion 22 in the person's neck region. The vibratory pulses thereby help to relax the muscles in the neck region.

The isometric exercise device 10 can also be used to exercise and massage other muscle groups in the body. The variety of exercises and the regions of the body that are massaged are only limited by the person's imagination.

The isometric exercise device 10 of the present invention thereby makes exercising more enjoyable for the person. When exercise becomes more enjoyable it is more likely that the person will exercise for longer periods of time but also exercise at more frequent intervals.

It is also possible to use the isometric exercise device 10 in solely a massaging mode. In this mode, the person may use the handles 60 to retain the vibratory portion 22 proximate to an area of the body that is to be exercise. A person can thereby enjoy the benefits of the isometric exercise device 10 when the person does not desire to exercise.

Although the present invention has been described with reference to preferred embodiments, workers skilled in the art will recognize that changes may be made in form and detail without departing from the spirit and scope of the invention.

What is claimed is:

1. An exercise device comprising: a stretchable member; and a vibratory portion that is retained in a captivated relationship with respect to the stretchable member, wherein the vibratory portion comprises:

a vibratory mechanism having a vibratory motor, a plurality of batteries, and an expanded foam portion, wherein the vibratory motor and the plurality of batteries being disposed within the expanded foam portion; and a sleeve having a large passage and a pair of small passages, wherein the small passages are oriented opposite each other, wherein the large passage receives the vibratory mechanism, wherein the small passages receive the stretchable member, and wherein the vibratory portion is capable of providing a massaging action while a person performs an exercise using the stretchable member.

2. The exercise device of claim 1 wherein the stretchable member is constructed in the form of a continuous loop.

3. The exercise device of claim 2 wherein the stretchable member is formed from a latex surgical rubber tubing.

4. The exercise device of claim 1 wherein the sleeve is formed from a material selected from the group consisting of cloth, vinyl, and leather.

5. The exercise device of claim 4 and further comprising a protective layer substantially covering the expanded foam portion.

6. The exercise device of claim 5 wherein the protective layer includes an access port.

7. The exercise device of claim 6 wherein the access port is maintained in a closed relation with a zipper.

8. The exercise device of claim 6 wherein the access port is maintained in a closed relation with a a hook and loop fastener.

9. The exercise device of claim 1 and further comprising a switch for controlling the operation of the vibratory motor.

10. The exercise device of claim 1 and further comprising a pair of handles that are captivated within a portion of the stretchable member.

11. The exercise device of claim 10 wherein the handles contain a plurality of indentions that are oriented on the handle to conform with a person's hand.

12. A exercise device comprising:

a stretchable member;

a vibratory mechanism comprising:

a vibratory motor;

a plurality of batteries; and an expanded foam portion, wherein the vibratory motor and the plurality of batteries are disposed within the expanded foam portion; and a sleeve having a large passage and a pair of small passages, wherein the small passages are oriented opposite each other adjacent to the large passage, wherein the large passage receives the vibratory mechanism, wherein the small passages receive the stretchable member, and wherein the vibratory portion is capable of providing a massaging action to a person's body while the person is performing an exercise using the stretchable member.

13. The exercise device of claim 12, wherein the stretchable member is latex surgical tubing formed into a continuous loop.

14. The exercise device of claim 13, wherein the vibratory mechanism has a substantially cylindrical shape having a diameter and wherein the large passage conforms with the diameter of the vibratory mechanism so that the vibratory mechanism is removably retained in the large passage.

15. The exercise device of claim 14, wherein the stretchable member is substantially cylindrical having a diameter and wherein the small passages are selected with a diameter that approximately conforms with the diameter of the stretchable member.

16. The exercise device of claim 12 wherein the vibratory mechanism further comprises a protective layer substantially covering the expanded foam portion.

17. The exercise device of claim 12 wherein the vibratory mechanism further comprises a switch for controlling the operation of the vibratory motor.

18. The exercise device of claim 12 and further comprising a pair of handles that are captivated within a portion of the stretchable member.

19. The exercise device of claim 18 wherein the handles contain a plurality of indentions that are oriented on the handle to conform with a person's hand.

20. A exercise device comprising:

a latex surgical tubing formed into a continuous loop, wherein the latex surgical tubing is substantially cylindrical having a diameter;

a pair of handles that are captivated within a portion of the latex surgical tubing, wherein each of the handles includes a plurality of indentions that are oriented on the handle to conform with a person's hand;

a vibratory mechanism having a substantially cylindrical shape with a diameter, wherein the vibratory mechanism comprises:

a vibratory motor;

a switch for controlling the operation of the vibratory motor;

a plurality of batteries;

an expanded foam portion, wherein the vibratory motor and the plurality of batteries are disposed within the expanded foam portion; and a protective layer substantially covering the expanded foam portion; and a sleeve having a large passage and a pair of small passages, wherein the small passages are oriented opposite each other adjacent to the large passage, wherein the large passage is adapted to receive the vibratory mechanism, wherein the large passage conforms with the diameter of the vibratory mechanism so that the vibratory mechanism is removably retained in the large passage, wherein the small passages are each adapted to receive the stretchable member, wherein the small passages are selected with a diameter that approximately conforms with the diameter of the stretchable member, and wherein the vibratory portion is capable of providing a massaging action to a person's body while the person is performing an exercise using the stretchable member.

* * * * *